United States Patent [19]

Lindblad et al.

[11] 3,973,843

[45] Aug. 10, 1976

[54] ELECTROSTATOGRAPHIC IMAGING APPARATUS

[75] Inventors: Nero R. Lindblad, Palmyra; Gordon E. Johnson, Webster; James H. Sharp, Rochester, all of N.Y.

[73] Assignee: Xerox Corporation, Stamford, Conn.

[22] Filed: Aug. 3, 1972

[21] Appl. No.: 277,544

[52] U.S. Cl. ..... 355/3 R

[51] Int. Cl.[2] ..... G03G 15/00

[58] Field of Search ..... 355/3; 96/1.4; 117/17.5

[56] References Cited

UNITED STATES PATENTS

| | | | |
|---|---|---|---|
| 3,501,294 | 3/1970 | Joseph | 96/1.4 |
| 3,652,319 | 3/1972 | Amidon et al. | 96/1.4 X |
| 3,682,689 | 8/1972 | Dueltgen et al. | 96/1.4 X |
| 3,725,059 | 4/1973 | Komp | 96/1.4 |

*Primary Examiner*—John Gonzales

*Attorney, Agent, or Firm*—James J. Ralabate; John H. Faro; James H. Laughlin

[57] ABSTRACT

An improved electrostatographic process wherein the imaging surface of the imaging member is treated with a lubricating effective amount of a compound selected from the group consisting of ortho-, meta-, para-phthalic acid, their corresponding metal or ammonium salts, and mixtures thereof. Controlled treatment of the imaging surfaces of the imaging member with the above compound(s) facilitates transfer of the developed image from the imaging member to a receiving sheet and removal of toner residues from the imaging surface upon cleaning. The imaging member element of the apparatus used in carrying out this process is covered with a thin film of lubricant over substantially all of its imaging surface thereby greatly improving toner transfer and removal.

8 Claims, 4 Drawing Figures

ELECTROSTATOGRAPHIC IMAGING APPARATUS

BACKGROUND OF THE INVENTION

1. Field of the Invention

This invention relates to an improved electrostatographic imaging process, an apparatus used in the above process and an imaging member. More specifically, the improved electrostatographic imaging process of this invention involves treating the imaging surface of the photoconductor or imaging member of the electrostatographic apparatus with a lubricating effective amount of at least one compound selected from the group consisting of phthalic acid, isophthalic acid, terephthalic acid, the metal and ammonium salts thereof. By providing a film of lubricant over substantially all of the imaging surface, transfer and removal of toner particles from the imaging surface is facilitated.

2. Description of the Prior Art

The formation and development of images on the surface of photoconductive materials by electrostatic means is well known. The basic xerographic process as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting latent electrostatic image by depositing on the image a finely divided electroscopic material referred to in the art as "toner". The toner will normally be attracted to those areas of the layer which retain a charge, thereby forming a toner image corresponding to the latent electroscopic image. This powder image may then be transferred to a support surface such as paper. The transferred image may subsequently be permanently affixed to the support surface by heat. Other suitable fixing means such as solvent or overcoating treatment may be substituted for the foregoing heat fixing step.

Many methods are known for applying the electroscopic particles to the latent electrostatic image to be developed. One development method as disclosed by E. N. Wise in U.S. Pat. No. 2,618,552 is known as "cascade" development. In this method, developer material comprising relatively large carrier particles having finely divided toner particles electrostatically clinging to their surface is conveyed to and rolled or cascaded across the latent electrostatic image bearing surface. The composition of the toner particles is so chosen as to have a triboelectric polarity opposite that of the carrier particles. In order to develop a negatively charged latent electrostatic image, an electroscopic powder and carrier combination should be selected in which the powder is triboelectrically positive in relation to the carrier. Conversely, to develop a positively charged latent electrostatic image, the electroscopic powder and carrier should be selected in which the powder is triboelectrically negative in relation to the carrier. This triboelectric relationship between the powder and carrier depends on their relative positions in a triboelectric series where the materials are arranged in such a way that each material is charged with a positive electrical charge when contacted with any material below it in the series and with a negative electrical charge when contacted with any material above it in the series. As the mixture cascades or rolls across the image bearing surface, the toner particles are electrostatically deposited and secured to the charged portions of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images.

Another technique for developing electrostatic images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brush-like configuration. This "magnetic brush" is engaged with an electrostatic image bearing surface and the toner particles are drawn from the brush to the electrostatic image by electrostatic attraction. Many other methods such as "touchdown" development, as disclosed by C. R. Mayo in U.S. Pat. No. 2,895,847, are known for applying electroscopic particles to electrostatic latent images to be developed. The development processes, as mentioned ahbove, together with numerous variations, are well known to the art through various patents and publications and through the widespread availability and utilization of electrostatographic imaging equipment.

In automatic xerographic equipment, it is conventional to employ a xerographic plate in the form of an endless imaging surface, which is continuously rotated through a cycle of sequential operations including charging, exposing, developing, transfer and cleaning. The plate is usually charged by means of a corona generating device of the type disclosed by L. E. Walkup in U.S. Pat. No. 2,777,957, which is connected to a suitable source of high potential. After forming a powder image on the electrostatic latent image during the development step, the powder image is electrostatically transferred to a support surface by means of a corona generating device, such as the corona device mentioned above. In automatic equipment employing a rotating drum, a receiving surface, to which a powder image is to be transferred, is moved through the equipment at the same rate as the periphery of the drum and contacts the drum at the transfer position interposed between the drum surface and the corona generating device. Transfer is effected by a corona generating device which imparts an electrostatic charge to attract the powder image from the drum to the support surface. The polarity of charge required to effect image transfer is dependent upon the visual form of the original copy relative to the reproduction and the electroscopic characteristics of the developing material employed to effect development. For example, where a positive reproduction is to be made of a positive original, it is conventional to employ a positive polarity corona to effect transfer of a negatively charged toner image to a receiving surface. When a positive reproduction from a negative original is desired, it is conventional to employ a positively charged developing material which is repelled by the charged areas on the plate and deposits on the discharged areas to form a positive image which may be transferred by negative polarity corona. In either case, a residual powder image usually remains on the plate after transfer. Before the plate may be reused for a subsequent cycle, it is necessary that the residual image be removed to prevent "ghost images" from forming on subsequent copies and to prevent residual film buildup on the photoreceptor. In the positive to positive reproduction process described above, the residual developer powder is tightly retained on the plate surface by a phenomenon that is not fully understood but believed to be caused by an electrical charge that prevents complete transfer of the powder to the receiving surface, particularly in the image area. This charge is substantially neutralized by means of a corona generating device prior to contact of the residual powder image with a cleaning device. The neutralization of the charge enhances the cleaning efficiency of the cleaning device.

Various electrostatographic plate cleaning devices such as "brush" cleaning apparatus and "web" type cleaning apparatus are known in the prior art. A typical brush cleaning apparatus is disclosed by L. E. Walkup et al. in U.S. Pat. No. 2,832,977. Brush type cleaning means usually comprise one or more rotating brushes, which brush residual powder from the plate into a stream of air which is exhausted through a filtering system. A typical web cleaning device is disclosed by W. P. Graff, Jr, et al. in U.S. Pat. No. 3,186,838. As disclosed by Graff, Jr. et al., removal of the residual powder from the plate is effected by passing a fibrous web material over the plate surface.

The sensitivity of the imaging member to abrasion, however, requires that special precautions be exercised during the cleaning phase of the copying cycle. For example, pressure contact between cleaning webs and imaging surfaces must be kept to a minimum to prevent rapid destruction of the imaging surface. Although thick protective coatings would protect the imaging surfaces for longer periods of time, the electrical properties of the imaging member layer impose certain limitations as to the acceptable maximum thickness of the coating. Since thick protective coatings are normally applied by conventional coating techniques, including the use of a film forming material suspended in a solvent, considerable inconvenience, expense and time is involved in removing the photoreceptor from the machine, preparing the eroded photoreceptor surface for reception of a new coating, applying the new coating, allowing the new coating to dry and reinstalling the newly coated photoreceptor into the machine. Certain extremely thin films, applied to the imaging surface as a pretreatment or in situ during the machine sequence, have been successful, however, the art is constantly on the lookout for improved films or at least practical alternatives. Furthermore, for reasons which are not entirely clear, toner particles are frequently difficult to remove from some photoreceptor coating materials, and toner accumulation causes deterioration of subsequent images formed on the photoreceptor surface in reusable imaging systems. Thus, there is a continuing need for a better system for protecting imaging surfaces, developing electrostatic latent images and removing residual developed images.

It is, therefore, the objective of this invention to provide an improved imaging process and system to overcome the above noted deficiencies in the prior art.

A more specific objective of this invention is to provide an improved electrostatographic imaging process permitting greater ease of transfer and removal of toner particles from the surface of the imaging member.

Another of the objectives of this invention is to provide an improved imaging member having an adherent film of lubricant over substantially all of its imaging surface.

Still yet another of the objectives of this invention is to provide an apparatus for carrying out the above process.

SUMMARY OF THE INVENTION

The foregoing and related objectives are accomplished by providing an imaging process which comprises the steps of forming a latent electrostatic image on an imaging surface, developing said latent image by bringing an electrostatographic developing material within the influence of said latent image thereby enabling formation of a powder image on the imaging surface corresponding to the latent image and removing at least a portion of at least any residual developed image from the imaging surface; wherein the improvement comprises treating at least a portion of said imaging surface with a lubricating effective amount of at least one compound selected from the group consisting of phthalic acid, isophthalic acid, terephthalic acid, the metal and ammonium salts thereof. Such treatment of the imaging surface is usually performed prior to latent image formation and subsequent to removal of residual developed image from the imaging member.

This invention also embraces an imaging member treated with an adherent film of the above lubricating agent(s) as well as an electrostatographic apparatus having such a treated imaging member.

In the preferred embodiments of this invention, the apparatus is an automatic electrostatographic copier having a continuous imaging member and means for application of the above lubricant to said imaging member. The preferred lubricant of this invention is terephthalic acid or its corresponding metal or ammonium salt and lubricant mixes containing terephthalic acid or its corresponding metal or ammonium salt.

It is intended by the phrases "metal salts" and "ammonium salts" of phthalic acid, isophthalic acid and terephthalic acid to describe the monovalent mono- or dicarboxylates of said acids. Likewise, in the case of di- or polyvalent metals, such acid salts include the carboxylates of one or more acid molecules. Representative of some of these metals are the alkali metals—lithium, sodium, potassium, rubidium, cesium; and the alkaline earth metals—magnesium, calcium, strontium, barium. Salt forming metals of the above acids also include such elements as zinc, cadmium, aluminum, $Fe^{+++}$, cobalt, lead, silver, $Cu^{++}$, and nickel.

DESCRIPTION OF THE INVENTION INCLUDING PREFERRED EMBODIMENTS

Process

In the electrostatographic process of this invention, the imaging member is treated with a lubricant of the type described previously. The method of treatment must be designed to insure the deposition of a substantially adherent film over at least 20% of the imaging surface of the imaging member during cyclic use. The term "film" is inclusive of continuous and discontinuous coatings of lubricants on the imaging surface of the imaging member.

The depth of this lubricant film on the imaging member must also be carefully monitored in order to insure that sufficient quantities of lubricant have been deposited on the imaging surface to effectively assist in the transfer and release of toner particles from its surface. The amount of lubricant required to be deposited on the imaging surface of the imaging member to effectively achieve the objectives of this invention should be sufficient to provide a film on said imaging surface of at least about 1A in average depth. If excessive amounts of lubricant are allowed to build up on the imaging surface, imaging and development on said surface can be adversely affected. Lubricant films having an average depth of from about 1–200A appear to provide the imaging surface with a good balance of imaging, development and toner release properties and are, therefore, preferred.

Any effective means can be used to maintain the lubricant film depth within the above specified limits. Whatever the means ultimately selected for maintaining the depth of this lubricant film at a predetermined level, it must not, however, be so effective as to strip the imaging surface clean of lubricant. Means for example which can be used to dispense and maintain the lubricant film within the above specified limits can be a rotating brush, a fibrous web, a wiper blade, a sponge-like material, an aerosol or any combination thereof. The depth of the lubricant film on the imaging surface can be continuously monitored by any of a number of well-known techniques. For example, one could readily determine such layer thickness spectrophotometrically by simply taking comparative readings from a treated and untreated portion of the drum at a fixed wavelength; or by incorporating radioactive tracer materials into the lubricant used in treating the imaging surface and measuring the amount of radioactivity on the treated imaging surface.

Figure 1:
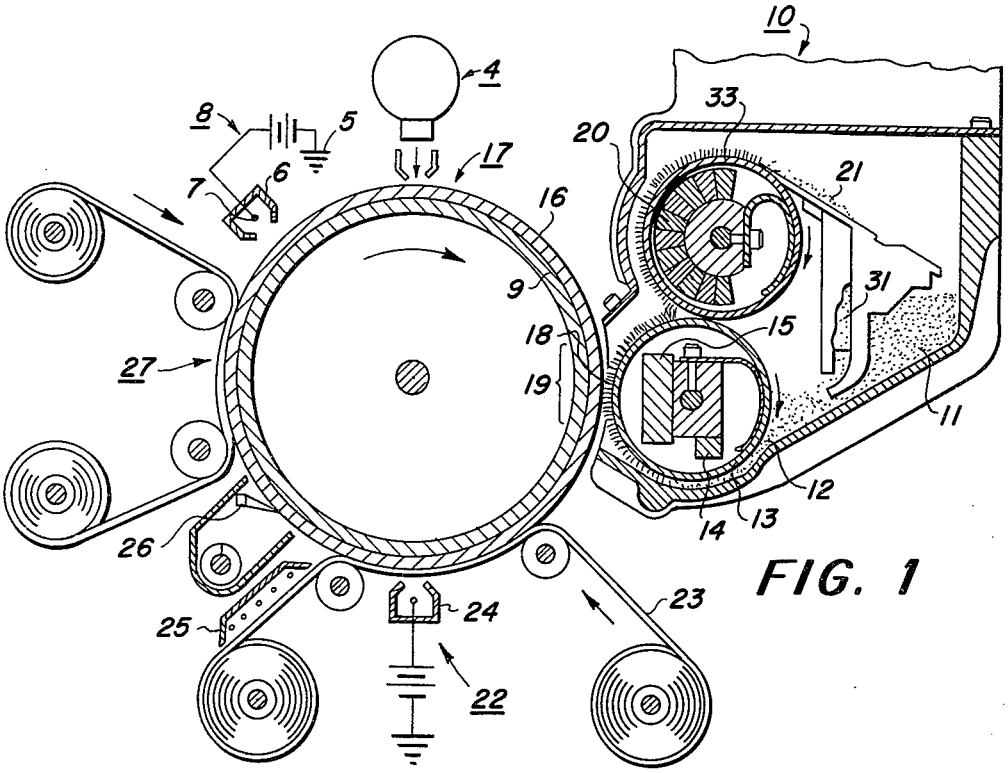
FIG. 1 is an elevational view in vertical cross-section of an automatic electrostatographic copier having a continuous imaging member and an impregnated web arrangement for dispensing lubricant.

This process is hereinafter described by reference to FIGS. 1–4. Referring initially to FIG. 1, an automatic electrostatographic imaging apparatus is shown which comprises a drum-like imaging member 17, having a light sensitive insulative layer 16 operatively associated with an electrically conductive substrate 9 rotatably mounted to enable the light sensitive insulative layer or imaging surface of the imaging member to sequentially pass in the direction indicated by the arrow past a plurality of electrostatographic processing stations located peripherally to the imaging surface.

For the purposes of the present disclosure, the several electrostatographic processing stations located peripherally to the imaging surface are functionally typical of those routinely employed in an electrostatographic reproduction cycle and can be described as follows.

A charging station 8, preferably located as indicated in FIG. 1 comprising a corona discharge device which includes an array of one or more corona discharge electrodes 7 partially enveloped within a shield 6 and energized from a high potential source 5, ionizes the air proximate to the imaging surface of the imaging member, thereby imparting a uniform surface charge thereto. Once charged, that portion of the imaging surface bearing the surface charge is subjected to exposure by a light image at exposure station 4 wherein an optical scanning projection system projects an image onto the charged imaging surface from a stationary original thereby forming a latent electrostatic image on said imaging surface.

The imaging surface bearing this latent electrostatic image then revolves to a development station 10 where a developer 11 is drawn from a sump 12 to a rotatable applicator sleeve 13 by a pick-up magnet 14 located within the applicator sleeve. As the applicator sleeve rotates in the direction indicated by the arrow, the attracted developer frictionally moves with the applicator sleeve to a brush forming magnet 15 (also located within the applicator sleeve), resulting in alignment of the developer along the lines of flux generated by the brush forming magnet between the applicator sleeve and the imaging surface 16 of the imaging member 17. The aligned developer particles form a soft brush-like structure 18 which, upon counterrotation of the applicator sleeve and the imaging member "wipes" the imaging surface, selectively depositing developer particles on the imaged areas of the imaging surface.

After the applicator sleeve bearing the brush-like developer structure revolves beyond development zone 19, the developer passes under the influence of a third magnet 20 located within a pick-off sleeve 33. As the pick-off sleeve revolves in the direction indicated by the arrow, developer particles, attracted by the internal field of magnet 20 are transferred from the applicator to the pick-off sleeve and consequently transported to a replenishment zone 21. In this replenishment zone additional toner and carrier are added to the recovered developer and the resultant mixture tumbled through a series of angularly inclined baffles 22 returning ultimately to the sump. This baffle arrangement should provide for uniform distribution of developer in the sump in order to insure presentation of a continuous supply of developer along the surface of the applicator sleeve disposed opposite pick-up magnet 14. Positioned subsequent to the developer station along the arc of travel of the imaging member is an image transfer station 32, where a transfer sheet 23, such as paper, is fed in coordination with the presentation of the developed image on the drum. Concurrent with presentation of the transfer sheet opposite the developed image, an electrostatic field is created by a corona discharge device 24 on the underside of the transfer sheet so as to effectively tack the developed image to the transfer sheet. This synchronous movement of the transfer sheet along the imaging member permits transfer of the developed image to this sheet where it can be subsequently more permanently affixed by means of heat fusion device 25 or other well known techniques. After the developed image is transferred to the receiving sheet and the receiving sheet picked off the drum, substantially all residual toner particles remaining on the imaging surface are removed by impinging a doctor blade 26 in a chiseling attitude against said imaging surface. Upon removal of substantially all residual toner particles from the imaging surface, said imaging surface is contacted with a fibrous web material 27 which has been impregnated with one or more of the aforedescribed lubricants. As this impregnated web advances over the imaging surface in the direction indicated by the arrow an adherent film of lubricant is deposited over substantially all of said imaging surface.

Figure 2:
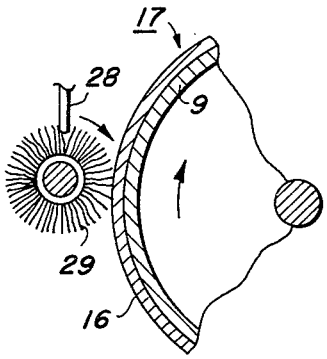
FIG. 2 is an elevational view in vertical cross-section of a bar-brush arrangement for dispensing lubricant on the imaging surface of an imaging member.

In FIG. 2, the imaging surface is treated with lubricant by a rotating brush 29 impinging upon the imaging surface of the imaging member. As the brush rotates, it picks up lubricant from an erodible lubricant bar 28 which is fed at a controlled rate toward the brush.

Figure 3:
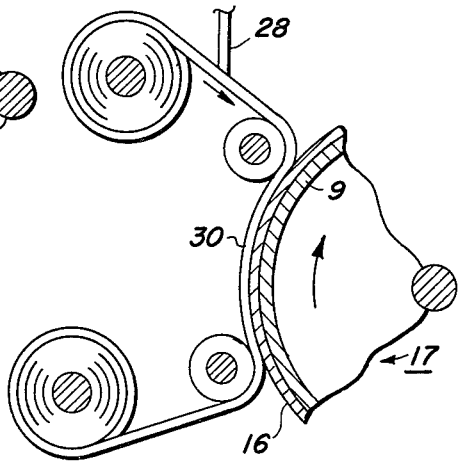
FIG. 3 is an elevational view in vertical cross-section of a bar-web arrangement for dispensing lubricant on the imaging surface of an imaging member.

In FIG. 3, the imaging surface is treated with lubricant in the manner illustrated by FIG. 1; however, lubricant is applied to the fibrous web 30 topically by controlled feeding of an erodible lubricant bar 28 against the surface of the web prior to the web impinging upon the imaging surface of the imaging member.

Figure 4:
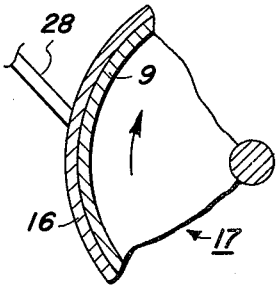
FIG. 4 is an elevational view in vertical cross-section of solid bar arrangement for dispensing lubricant on the imaging surface of an imaging member.

In FIG. 4, the lubricant is dispensed directly onto the imaging member by controlled feeding of an erodible lubricant bar 28 against the imaging surface. In each of the above specific embodiments illustrated in FIGS. 1–4, the depth of the lubricant film on the imaging surface is controlled by the same doctor blade used in removal of toner residues.

Imaging Member

The imaging member referred to hereinabove in discussion of the process and apparatus of this invention can comprise any known reusable electrostatographic imaging surface. The physical shape and dimensions of this element can vary with the type and function of apparatus in which it is employed. For example, in an automatic or cyclic copying system, the imaging member will usually be either drum shaped, having a reusable imaging surface on its exterior wall, or an endless or a disposable belt. Other apparatus may call for the imaging member to be in the form of a plate; and under such circumstances the imaging layer will usually be on at least one of the surfaces of the plate.

As indicated above, the imaging member can be any suitable imaging surface, including conventional photoconductive and nonphotoconductive surfaces. Well-known photoconductive materials include vitreous selenium, zinc oxide, organic or inorganic photoconductors embeded in a nonphotoconductive matrix or inorganic or organic photoconductors embedded in a photoconductive matrix or homogeneous organic photoconductors, typified by PVK/TNF photoconductors and the like. Representative patents which disclose contemplated photoconductive materials include U.S. Pat. Nos. 2,803,542; 2,970,906; 3,131,006; 3,121,007 3,151,982 and 3,484,237. The preferred imaging member used in the process and apparatus of this invention has a selenium based imaging surface on a rigid electrically conductive substrate, such as aluminum. The physical shape of this reusable imaging member should preferably be suited for cyclic or automatic operation in an electrostatographic copying system.

The application and maintenance of an adherent film of lubricant on at least a portion of the imaging surface of this type of electrostatographic imaging member protects the imaging surface from abrasion, facilitates image development, developed image transfer and minimization of toner filming or buildup on the imaging surface.

The exact mechanism by which the previously described compound(s) affect adherence of toner to the imaging surface of the imaging member is not as yet known.

PREFERRED EMBODIMENTS

The Examples which follow further describe, define and illustrate specific embodiments of the process and apparatus of this invention. Example I and XV are included to provide a standard against which the performance of the treated imaging members can be gauged. Process conditions and apparatus specifications, where not explicitly set forth, are presumed to be standard and as hereinbefore described.

EXAMPLE I

The vitreous selenium photoconductive drum of an automatic electrostatographic copier is corona charged to a positive voltage of about 800 volts, exposed to a light and shadow image thereby forming a latent electrostatic image on the imaging surface of the drum, and developed by the hereinbefore described magnetic brush technique using a standard polystyrene-cabon black toner blend; the average particle size of toner particles being about 12 microns. After development, the developed image is transferred to a sheet of paper, the paper bearing the developed image picked off the drum, the toner image fused on the paper, and the residual toner particles then removed from the imaging surface by a doctor blade set against the imaging surface at a chiseling attitude.

Initial copies reveal good copy quality in all respects, however, after 500 copies image quality is markedly inferior showing high background density, poor image fill and decreased image resolution. Inspection of the drum reveals a highly visible toner film buildup on the imaging surface.

EXAMPLE II

The toner laden drum of Example I is removed from the copier, thoroughly cleaned and reinstalled in the copier. The apparatus is then modified by the addition of a lubricant dispensing station between the doctor blade and the charging station. This lubricant dispensing station comprises fibrous a fibrous material impregnated with terephthalic acid. As the vitreous drum rotates through its copy reproduction cycle, an adherent film FIG. 1. terephthalic acid is deposited over substantially all the imaging surface of this imaging member in the manner shown in FIG.1. Copy quality remains relatively constant even after 500 copies in comparison to Example I, and inspection of the imaging surface of the drum does not reveal undesirable toner buildup of the type experienced in Example I.

EXAMPLES III – XIV

Example II is repeated except for substitution of the following lubricants for the terephthalic acid.

| Example No. | Lubricant |
|---|---|
| III | phthalic acid |
| IV | isophthalic acid |
| V | sodium salt of terephthalic acid |
| VI | sodium salt of phthalic acid |
| VII | sodium salt of isophthalic acid |
| VIII | calcium salt of terephthalic acid |
| IX | calcium salt of phthalic acid |

-continued

| Example No. | Lubricant |
|---|---|
| X | calcium salt of isophthalic acid |
| XI | ammonium salt of tere-phthalic acid |
| XII | terephthalic acid: phthalic acid (1:1 ratio) |
| XIII | terephthalic acid:iso-phthalic acid (1:1 ratio) |

In each of Examples II–XIII, copy quality after 500 copies was better than Example I and preceptibly less toner residue appeared on the imaging surface of the photoconductive drum than observed in Example I.

EXAMPLE XIV

Example II is repeated except for the substitution of a bar-brush lubricant dispensing station for the impregnated web of Example II. The lubricant, tere-phthalic acid, in the form of a solid bar is transferred to the brush by the erosive action of the brush bristles as they strike the bar. As the vitreous selenium drum of the copier revolves through its reproduction cycle, an adherent film of tere-phthalic acid is deposited over substantially all of the imaging surface of the drum by the action of the rotating brush against the drum. The copy quality remains relatively constant even after 500 copies in comparison to Example I, and inspection of the drum does not reveal undesirable toner buildup of the type experiences in Example I.

EXAMPLE XV

Example I is repeated except that the copier is equipped with a poly-N-vinylcarbazole photoconductive imaging member of a type disclosed in U.S. Pat. No. 3,484,237. Here, as in Example I, toner filming of the photoconductive surface of the imaging member is observed after only 500 copies with noticeable deterioration in copy quality.

EXAMPLE XVI

Example XV is repeated except that (*a*) the toner laden photoconductive imaging member of Example XV is replaced by a clean, unused imaging member of the same composition, and (*b*) copier is modified by the addition of a lubricant dispensing station between the doctor blade and the charging station. This lubricant dispensing station comprises a fibrous web material impregnated with terephthalic acid. As the flexible photoconductive imaging member rotates through its copy reproduction cycle, an adherent film of terephthalic acid is deposited over substantially all of its imaging surface in the manner illustrated in FIG. 1. Copy quality remains relatively constant even after 500 copies in comparison to example XV, and inspection of the flexible photoconductive member does not reveal the undesirable toner filming observed in Example XV.

What is claimed is:

1. In an electrostatographic apparatus having an imaging member, means for forming a latent electrostatic image on the imaging surface of said imaging member, means for developing said latent image and means for removing at least a portion of at least any residual developed image from the imaging surface of the imaging member;

the improvement comprises providing an imaging member wherein the imaging surface is treated with an adherent film of lubricant, said lubricant having at least one compound selected from the group consisting of phthalic acid, isophthalic acid, terephthalic acid, the metal and ammonium salts thereof.

2. The electrostatographic copier of claim 1, wherein the adherent film of lubricant is distributed over substantially all of the imaging surface.

3. In an electrostatographic apparatus having an imaging member, means for forming a latent electrostatic image on the imaging surface of said imaging member, means for developing said latent image on said imaging surface, and means for removing at least a portion of at least any residual developed image from the imaging surface of said imaging member;

the improvement comprising providing means for dispensing a lubricating effective amount of lubricant on said imaging surface, said lubricant comprising at least one compound selected from the group consisting of phthalic acid, isophthalic acid, terephthalic acid, the metal and ammonium salts thereof.

4. The apparatus of claim 3 wherein the means for dispensing said lubricant comprises a fibrous web impregnated with said lubricant.

5. The apparatus of claim 3 wherein the means for dispensing said lubricant is an erodible lubricant bar impinging directly against the imaging surface.

6. The apparatus of claim 3 wherein the means for dispensing said lubricant comprises a rotating brush and erodible lubricant bar impinging upon said brush.

7. The apparatus of claim 3 wherein the means for dispensing said lubricant is a moving fibrous web and an erodible lubricant bar impinging upon said web.

8. The apparatus of claim 3 wherein the lubricant is terephthalic acid.

* * * * *